US012359887B2

(12) United States Patent
Painter

(10) Patent No.: US 12,359,887 B2
(45) Date of Patent: Jul. 15, 2025

(54) FIREARM BARREL WITH OUTER SLEEVE

(71) Applicant: Blackstone Firearms, LLC, Delavan, WI (US)

(72) Inventor: Aaron E Painter, Delavan, WI (US)

(73) Assignee: Blackstone Firearms, LLC, Delavan, WI (US)

( * ) Notice: Subject to any disclaimer, the term of this patent is extended or adjusted under 35 U.S.C. 154(b) by 88 days.

(21) Appl. No.: 17/957,474

(22) Filed: Sep. 30, 2022

(65) Prior Publication Data

US 2023/0022445 A1 Jan. 26, 2023

Related U.S. Application Data

(63) Continuation-in-part of application No. 17/087,676, filed on Nov. 3, 2020, now Pat. No. 11,680,765, which is a continuation-in-part of application No. 16/434,207, filed on Jun. 7, 2019, now Pat. No. 10,907,921, which is a continuation-in-part of application No. 15/394,155, filed on Dec. 29, 2016, now Pat. No. 10,365,061.

(51) Int. Cl.
*F41A 21/44* (2006.01)
*F41A 21/28* (2006.01)

(52) U.S. Cl.
CPC ..... *F41A 21/44* (2013.01); *F41A 21/28* (2013.01)

(58) Field of Classification Search
CPC ..... F41A 21/00; F41A 21/02; F41A 21/04; F41A 21/10; F41A 21/20; F41A 21/28; F41A 21/44
USPC ..... 89/16
See application file for complete search history.

(56) References Cited

U.S. PATENT DOCUMENTS

| | | | | |
|---|---|---|---|---|
| 855,439 | A | 6/1907 | Adrianson | |
| 2,249,899 | A | 7/1941 | Hogg | |
| 2,467,372 | A | 4/1949 | DePermentier | |
| 2,516,926 | A | 8/1950 | Simpson | |
| 2,655,837 | A | 10/1953 | Johnson | |
| 2,935,912 | A | 5/1960 | Hartley | |
| 2,965,994 | A | 12/1960 | Sullivan | |
| 3,118,243 | A | 1/1964 | Manshel | |
| 3,367,054 | A | 2/1968 | Loffler | |
| 3,486,411 | A | 12/1969 | Lichtenstern | |
| 3,742,640 | A | 7/1973 | Thomas | |
| 3,805,434 | A | 4/1974 | Sudano | |
| 3,872,771 | A | 3/1975 | Pierre et al. | |
| 4,058,050 | A | 11/1977 | Brouthers | |
| 4,211,146 | A * | 7/1980 | Bradley | F41A 21/02 89/16 |
| 4,304,061 | A | 12/1981 | Brouthers | |
| 4,638,713 | A | 1/1987 | Milne | |
| 4,646,615 | A | 3/1987 | Gladstone et al. | |
| 4,685,236 | A * | 8/1987 | May | F41A 21/02 42/76.02 |
| 4,762,048 | A | 8/1988 | Higashi | |

(Continued)

FOREIGN PATENT DOCUMENTS

GB 2350881 A * 12/2000 ..... F41A 21/28

*Primary Examiner* — Troy Chambers
*Assistant Examiner* — Benjamin S Gomberg
(74) *Attorney, Agent, or Firm* — RYAN KROMHOLZ & MANION, S.C.

(57) ABSTRACT

A firearm barrel assembly having a barrel tube and an outer sleeve. A sleeve nut is threaded on the barrel tube to retain the outer sleeve on the sleeve nut and to tension the barrel tube.

20 Claims, 13 Drawing Sheets

(56) References Cited

U.S. PATENT DOCUMENTS 4,769,938 A 9/1988 Chesnut
4,774,872 A 10/1988 Creedon
4,833,810 A 5/1989 Domian
4,841,836 A 6/1989 Bundy
4,911,060 A 3/1990 Greenspan
4,982,648 A 1/1991 Bol
5,125,179 A 6/1992 Campbell
5,160,802 A 11/1992 Moscrip
5,212,328 A 5/1993 Petrovich
5,214,234 A 5/1993 Divecha
5,255,615 A 10/1993 Talbot
5,341,719 A 8/1994 Bullis
5,355,765 A * 10/1994 Rogers ..... F41A 21/24 89/14.4
5,581,928 A 12/1996 Krumm
5,600,912 A 2/1997 Smith
5,650,586 A 7/1997 Balbo
5,692,334 A * 12/1997 Christensen ..... F41A 21/02 42/76.02
5,753,846 A * 5/1998 Koon ..... F41A 21/28 89/14.3
5,794,374 A 8/1998 Crandall
5,804,756 A 9/1998 Christensen
5,856,631 A 1/1999 Julier
5,915,937 A 6/1999 Christensen
5,928,799 A 7/1999 Sherman
6,189,431 B1 2/2001 Danner
6,230,429 B1 * 5/2001 Smith ..... F41A 21/02 42/76.01
6,314,857 B1 11/2001 Schmidt et al.
6,355,338 B1 3/2002 Hilmas
6,497,065 B1 12/2002 Huston
6,838,162 B1 1/2005 Gruber
6,889,464 B2 5/2005 Degerness
6,971,314 B2 12/2005 Maguire
7,353,741 B2 4/2008 Brixius
7,721,478 B2 5/2010 Withers
7,775,200 B2 8/2010 Anderson
7,810,272 B2 10/2010 Brixius
7,866,079 B2 1/2011 Keeney et al.
7,921,590 B2 4/2011 Briggs
7,934,332 B2 5/2011 Briggs
8,161,753 B2 4/2012 Benoit
8,281,698 B2 10/2012 Haywood
8,312,663 B2 * 11/2012 Johnson ..... F41A 23/16 42/76.01
8,316,568 B2 11/2012 Briggs
8,336,243 B2 12/2012 Langevin
8,677,670 B2 * 3/2014 Christensen ..... F41A 21/02 42/78
8,844,187 B2 9/2014 Pfersmann et al.
9,222,756 B1 12/2015 Battaglia
9,658,010 B1 5/2017 Oglesby
9,796,057 B2 10/2017 Tertin et al.
9,823,034 B2 * 11/2017 Johnson ..... F41A 21/36
10,066,898 B1 9/2018 Coburn et al.
10,365,061 B1 7/2019 Painter
10,533,820 B2 1/2020 McMillan
10,584,933 B2 3/2020 Lagenbeck
10,690,440 B2 6/2020 Coburn et al.
10,907,942 B2 2/2021 Greenwood
11,079,194 B1 * 8/2021 Sinnema ..... F41A 21/02
11,385,013 B2 7/2022 Boretto et al.
11,680,765 B1 6/2023 Painter
11,732,988 B2 8/2023 Boretto et al.
12,050,074 B1 7/2024 Painter
2004/0244257 A1 * 12/2004 Degerness ..... F41A 21/02 42/76.02
2005/0115398 A1 6/2005 Olson
2005/0132872 A1 6/2005 Jansen
2005/0229464 A1 * 10/2005 Olson ..... F41B 11/00 42/76.02
2005/0262997 A1 12/2005 Brixius
2006/0207152 A1 9/2006 Lazor
2006/0236582 A1 10/2006 Lewis
2007/0256345 A1 11/2007 Hall
2008/0143005 A1 6/2008 Lim
2010/0162608 A1 7/2010 McCann
2011/0100204 A1 5/2011 Schlenkert
2011/0107647 A1 * 5/2011 Johnson ..... F41A 23/16 42/97
2011/0119981 A1 5/2011 Larue
2011/0146130 A1 * 6/2011 Emde ..... F41A 21/44 42/96
2011/0173864 A1 * 7/2011 Christensen ..... F41A 21/02 42/78
2011/0265365 A1 * 11/2011 Alonso Tricio ..... F41A 21/24 42/78
2011/0277623 A1 11/2011 Adolphsen
2012/0180358 A1 7/2012 Samson
2012/0227302 A1 9/2012 Fonte
2013/0036902 A1 * 2/2013 Adolphsen ..... F41A 5/26 89/193
2013/0061503 A1 3/2013 Klett et al.
2013/0247439 A1 * 9/2013 Johnson ..... F41A 13/12 42/97
2013/0276342 A1 10/2013 Chvala
2014/0030519 A1 1/2014 King, Jr.
2014/0076135 A1 3/2014 Balthaser et al.
2014/0082990 A1 3/2014 Lee
2015/0369558 A1 12/2015 Gottzmann
2016/0109204 A1 4/2016 Leone
2016/0209144 A1 * 7/2016 Tertin ..... B23P 11/025
2016/0290761 A1 10/2016 Cook, Jr
2017/0138692 A1 5/2017 Tubb
2017/0205172 A1 * 7/2017 Curliss ..... F41A 21/16
2017/0299299 A1 10/2017 Klett et al.
2018/0017350 A1 1/2018 Kowalski
2018/0023913 A1 1/2018 Newman
2018/0238652 A1 8/2018 Leone
2019/0024999 A1 1/2019 Aldophsen
2019/0226786 A1 7/2019 Sloan
2021/0252352 A1 8/2021 Greenwood et al.
2022/0163280 A1 * 5/2022 Boretto ..... F41A 21/02

* cited by examiner

Fig. 6
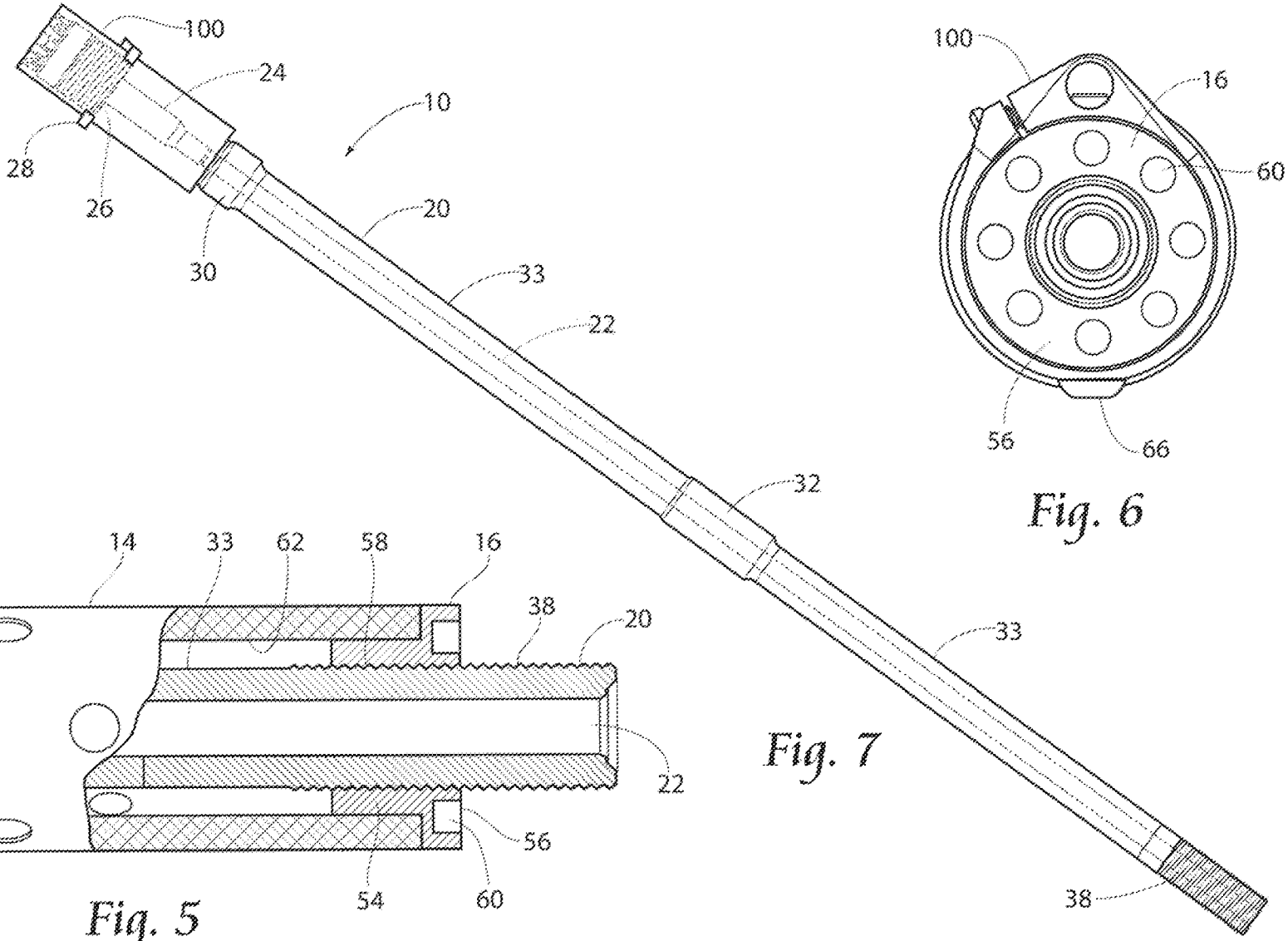
Fig. 7
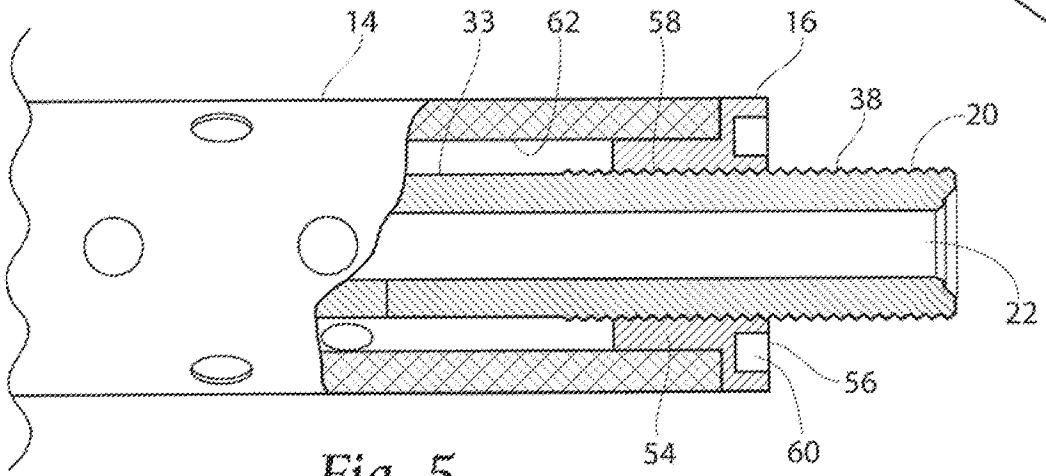
Fig. 5

FIREARM BARREL WITH OUTER SLEEVE

RELATED APPLICATIONS

The present application is a continuation-in-part of U.S. patent application Ser. No. 17/087,676, filed on 3 Nov. 2020, which is a continuation-in-part of U.S. patent application Ser. No. 16/434,207, filed on Jun. 7, 2019, which is a continuation-in-part of U.S. patent application Ser. No. 15/394,155, filed on Dec. 29, 2016, now U.S. Pat. No. 10,365,061.

BACKGROUND OF THE INVENTION

Field of the Invention

The present invention relates generally to firearms and more specifically to a firearm barrel with an outer sleeve, which may be handled after use.

Discussion of the Prior Art

It appears that the prior art does not teach or suggest a firearm barrel with non-metal outer sleeve, which may be handled after use.

Accordingly, there is a clearly felt need in the art for a firearm barrel with non-metal outer sleeve, which may be handled after repeated firings.

SUMMARY OF THE INVENTION

The present invention provides a firearm barrel with nonmetal outer sleeve, which may be handled after use. The firearm barrel with non-metal outer sleeve preferably includes a firearm barrel, a first non-metal tube, a second non-metal tube, a sleeve nut and a coupler bushing. The firearm barrel includes an elongated tube. A barrel inner diameter is formed through a length of the elongated tube. A lead-in bore is formed concentric with the barrel inner diameter at an entrance end of the elongated tube. A threaded tap is preferably formed in the entrance end of the elongated tube to threadably receive an extension barrel. Suitable twist rifling is then applied to the barrel inner diameter. Material is preferably removed from the elongated tube to form an end flange, a reduced outer diameter, a first raised sleeve support section and a raised coupler section. The end flange is formed on an entrance end of the elongated tube. The first sleeve support is formed near the end flange. The raised coupler section is formed in substantially a middle of the elongated tube. A gas escape hole is formed through the raised coupler section to the barrel inner diameter. A sleeve thread is formed on an exit end of the elongated tube. The firearm barrel is preferably fabricated from any suitable steel, but other materials may also be used.

The coupler bushing includes a bushing inner diameter, a first reduced diameter and a second reduced diameter. The first reduced diameter is formed on a first end of the coupler bushing and the second reduced diameter end formed on a second end thereof. A combination gas escape and fastener hole is formed through the coupler bushing. The bushing inner diameter is sized to slidably receive an outer diameter of the raised coupler section. The coupler bushing is preferably fabricated from any suitable metal, such as steel. The first non-metal tube includes a first tube inner diameter and a plurality of first openings are formed through a wall of the first non-metal tube. The plurality of first openings may have any suitable spacing, size and shape. The first tube inner diameter is sized to slidably receive an outer diameter of the first raised sleeve support section and the first reduced diameter. The first non-metal tube is preferably fabricated from carbon fiber, but other non-metal materials could also be used.

The sleeve nut preferably includes a tube end and a rotation flange. The rotation flange is formed on an end of the tube end. A threaded bore is formed through a length of the sleeve nut to threadably receive the sleeve thread of the elongated tube. A plurality of holes are preferably formed in the rotation flange to receive pins of a spanner wrench. However, wrench flats could be formed on an outer perimeter of the rotation flange. The second non-metal tube includes a second tube inner diameter and a plurality of second openings are formed through a wall of the second non-metal rube. The plurality of second openings may have any suitable spacing, size and shape. The second tube inner diameter is sized to slidably receive an outer diameter of the second reduced diameter and the tube end of the sleeve nut. The second non-metal tube is preferably fabricated from carbon fiber, but other non-metal materials could also be used.

The firearm barrel with non-metal outer sleeve is preferably assembled in the following manner. The first non-metal tube is slid over the exit end of the elongated tube on to the first raised sleeve support section. The coupler bushing is slid over the exit end of the elongated tube and on to the raised coupler section. The first reduced diameter of the coupler bushing is slid into the first tube inner diameter of the first non-metal tube. The combination gas escape and fastener hole of the bushing sleeve is aligned with the gas escape hole of the elongated barrel. A gas block is slid over the bushing sleeve. A threaded fastener is inserted through a hole in the gas block and the combination gas escape and fastener hole and threaded into a threaded tap in one end of the combination gas escape and fastener hole. The second non-metal tube is slid over the exit end of the elongated tube and on to the second reduced diameter of the coupler bushing. The sleeve nut is threaded onto the sleeve thread to retain the first and second non-metal tubes on the elongated tube.

A second embodiment of a firearm barrel with non-metal outer sleeve preferably includes a second firearm barrel, a non-metal tube and the sleeve nut. The second firearm barrel includes a second elongated tube. A second barrel inner diameter is formed through a length of the second elongated tube. Suitable twist rifling is applied to the second barrel inner diameter. Material is preferably removed from the second elongated tube to form an end taper, a reduced outer diameter and a raised sleeve support section. The end taper is formed near an entrance of the second elongated tube. The raised sleeve support section is formed adjacent the end taper. The raised sleeve preferably includes a straight knurled portion disposed in front of the raised sleeve support section. A sleeve thread is formed on an exit end of the second elongated tube. The firearm barrel is preferably fabricated from any suitable steel, but other materials may also be used.

The non-metal tube includes a tube inner diameter and a plurality of openings formed through a wall of the non-metal tube. The plurality of openings may have any suitable spacing, size and shape. The tube inner diameter is sized to slidably receive an outer diameter of the raised sleeve support section and the first reduced diameter. The non-metal tube is preferably fabricated from carbon fiber, but other non-metal materials could also be used.

The second embodiment of the firearm barrel with non-metal outer sleeve is preferably assembled in the following manner. The non-metal tube is slid over the exit end of the second elongated tube on to the raised sleeve support section. The sleeve nut is threaded onto the sleeve thread to retain the non-metal tube on the second elongated tube.

Accordingly, it is an object of the present invention to provide a firearm barrel with non-metal outer sleeve, which may be handled after repeated firings.

These and additional objects, advantages, features and benefits of the present invention will become apparent from the following specification.

BRIEF DESCRIPTION OF THE DRAWINGS

FIG. 5 is an enlarged cut-away view of a sleeve nut of a firearm barrel with non-metal outer sleeve in accordance with the present invention.

FIG. 6 is an enlarged end view of a firearm barrel with non-metal outer sleeve in accordance with the present invention.

FIG. 7 is a side view of an elongated tube of a firearm barrel with non-metal outer sleeve in accordance with the present invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
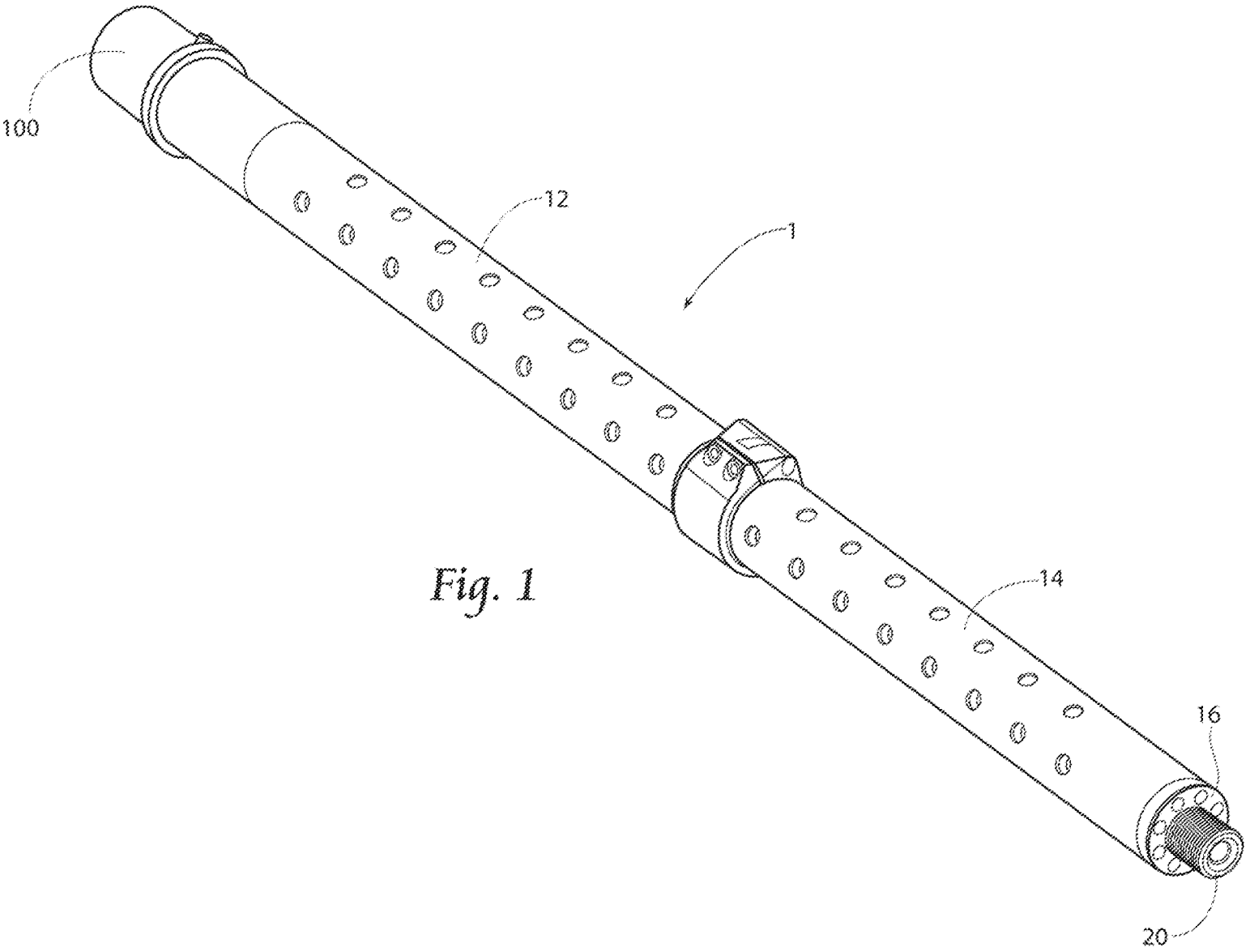
FIG. 1 is a perspective view of a firearm barrel with non-metal outer sleeve in accordance with the present invention.
Figures 2, 3, 4:
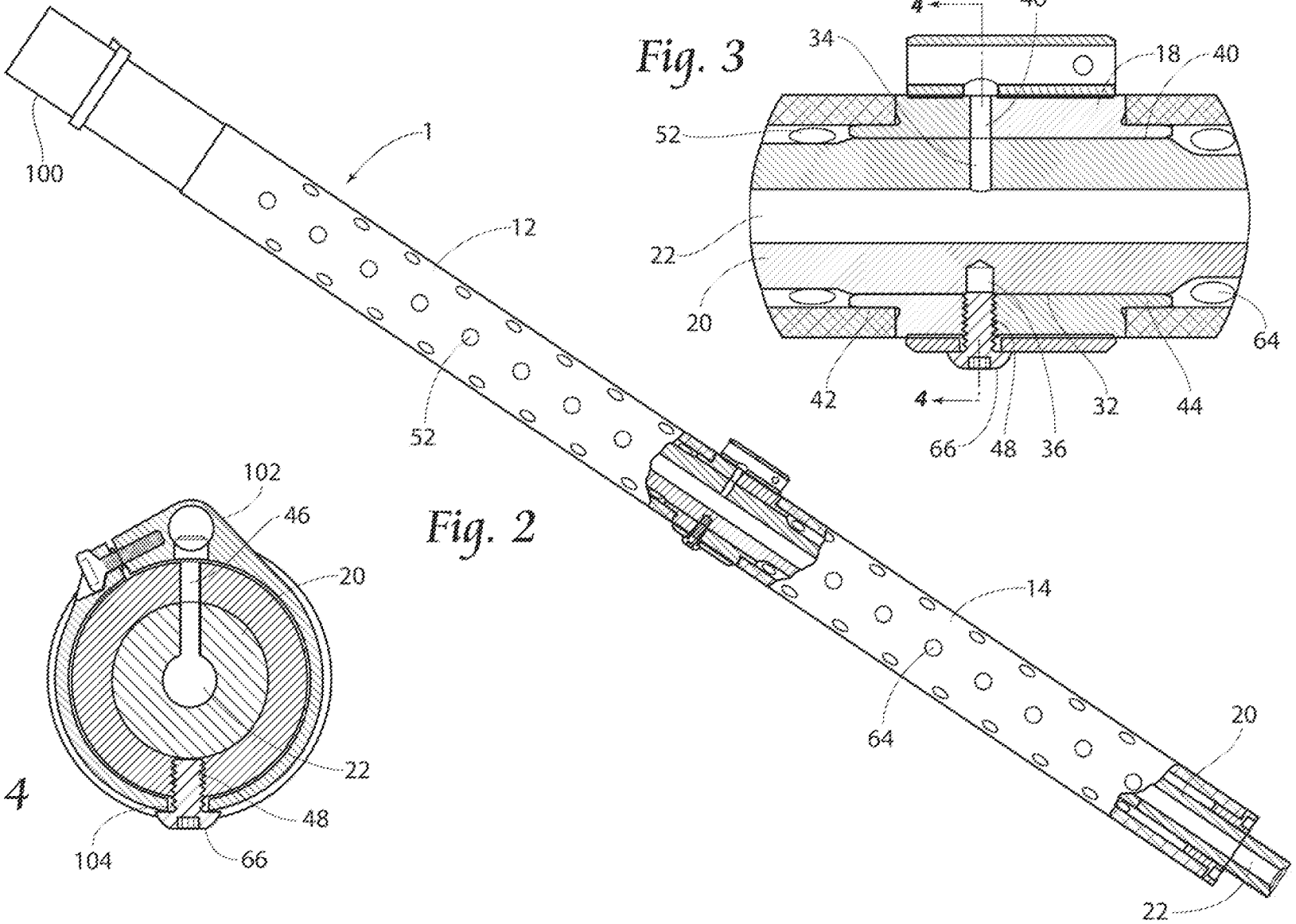
FIG. 2 is a side view of a firearm barrel with non-metal outer sleeve with cut-away sections of a gas block, coupler bushing and sleeve nut in accordance with the present invention.
FIG. 3 is an enlarged cut-away view of a gas block and coupler bushing of a firearm barrel with non-metal outer sleeve in accordance with the present invention.
FIG. 4 is an enlarged cross sectional view of a gas block and coupler bushing of a firearm barrel with non-metal outer sleeve cut through FIG. 3 in accordance with the present invention.

With reference now to the drawings, and particularly to FIG. 1, there is shown a perspective view of a firearm barrel with non-metal outer sleeve 1. With reference to FIGS. 2-7, the firearm barrel with non-metal outer sleeve 1 preferably includes a firearm barrel 10, a first non-metal tube 12, a second non-metal tube 14, a sleeve nut 16 and a coupler bushing 18. The firearm barrel 10 includes an elongated tube 20. A barrel inner diameter 22 is formed through a length of the elongated tube 20. A lead-in bore 24 is formed concentric with the barrel inner diameter 22 at an entrance end of the elongated tube 20. A threaded tap 26 is preferably formed in the entrance end of the elongated tube 20 to receive an extension barrel 100. Extension barrels are well known in the art and do not need to explained in detail. Suitable twist rifling is then applied to the barrel inner diameter 22. Material is preferably removed from the elongated tube 20 to form an end flange 28, a first raised sleeve support section 30, a raised coupler section 32 and a reduced outer diameter 33. The reduced diameter 33 has a diameter measurement, which is less than a diameter measurement of the first raised sleeve support section 30 and the raised coupler section 32. The end flange 28 is formed on the entrance end of the elongated tube 20. The first sleeve support 32 is formed near the end flange 28. The raised coupler section 32 is formed in substantially a middle of the elongated tube 20. A gas escape hole 34 is formed through the raised coupler section 32 to the barrel inner diameter 22. A barrel clearance hole 36 is formed in the raised coupler section 32, but not through to the barrel inner diameter 22. A sleeve thread 38 is formed on an exit end of the elongated tube 20. The firearm barrel 10 is preferably fabricated from any suitable steel, but other materials may also be used.

Figure 8:
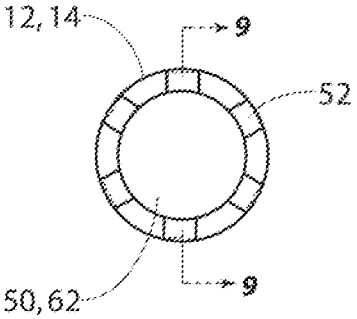
FIG. 8 is an end view of a first or second non-metal tube of a firearm barrel with non-metal outer sleeve in accordance with the present invention.
Figure 9:
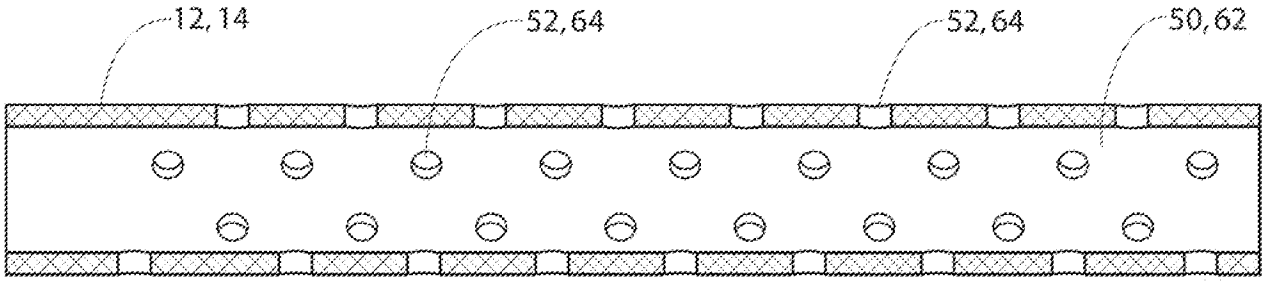
FIG. 9 is a cross-sectional view of a first or second nonmetal tube of a firearm barrel with non-metal outer sleeve cut through FIG. 8 in accordance with the present invention.

The coupler bushing IS includes a bushing inner diameter 40, a first reduced diameter 42 and a second reduced diameter 44. The first reduced diameter 42 is formed on a first end of the coupler bushing 18 and the second reduced diameter end 44 formed on a second end thereof. A combination gas escape and fastener hole 46 is formed through coupler bushing 18. A threaded tap 48 is formed in one end of the combination gas escape and fastener hole 46. The bushing inner diameter 40 is sized to slidably receive an outer diameter of the raised coupler section 32. The coupler bushing 18 is preferably fabricated from any suitable metal, such as steel. With reference to FIGS. 8-9, the first nonmetal tube 12 includes a first tube inner diameter 50 and a plurality of first openings 52 are formed through a wall of the first non-metal tube 12. The plurality of first openings 52 may have any suitable spacing, size and shape. The first tube inner diameter 50 is sized to slidably receive an outer diameter of the first raised sleeve support section 30 and the first reduced diameter 42. However, the first reduced diameter 42 may be threadably engaged with the inner diameter 50 of the first non-metal tube 12. The first non-metal tube 12 is preferably fabricated from carbon fiber, but other non-metal materials could also be used.

The sleeve nut 16 preferably includes a tube end 54 and a rotation flange 56. The rotation flange 56 is formed on an end of the tube end 54. A threaded bore 56 is formed through a length of the sleeve nut to threadably receive the sleeve thread 38 of the elongated tube 20. A plurality of pin holes 60 are formed in the rotation flange 56 to receive pins of a spanner wrench. The second non-metal tube 14 includes a second tube inner diameter 62 and a plurality of second openings 64 are formed through a wall of the second non-metal tube 14. The plurality of second openings 64 may have any suitable spacing, size and shape. The second tube inner diameter 62 is sized to slidably receive an outer diameter of the second reduced diameter 44 and the tube end 54 of the sleeve nut 16. However, the second reduced diameter 44 may be threadably engaged with the inner diameter 62 of the second nonmetal tube 14. The second non-metal tube 14 is preferably fabricated from carbon fiber, but other non-metal materials could also be used.

The firearm barrel with non-metal outer sleeve 1 is preferably assembled in the following manner. The first non-metal tube 12 is slid over the exit end of the elongated tube 20 on to the first raised sleeve support section 30. The coupler bushing 18 is slid over the exit end of the elongated tube 20 and on to the raised coupler section 32. The first reduced diameter 42 of the coupler bushing 18 is slid into a first tube inner diameter 50 of the first non-metal tube 12. The reduced diameter 33 has a diameter measurement, which is less than a diameter measurement of the first reduced diameter 42, the second reduced diameter 44 and the tube end 54 to create an air gap between the reduced diameter 33 and the first and second tube inner diameters 50, 64. The combination gas escape and fastener hole 46 of the bushing sleeve 18 is aligned with the gas escape hole 34 of the elongated barrel 20. A gas block 102 is slid over the bushing sleeve 18. A threaded fastener 66 is inserted through a hole 104 in the gas block 102 and threaded into the threaded tap 48 in the coupler bushing 18. The second non-metal tube 14 is slid over the exit end of the elongated tube 20 and on to the second reduced diameter 44 of the coupler bushing 18. The sleeve nut 16 is threaded onto the sleeve thread 38 to retain the first and second non-metal tubes 12, 14 on the elongated tube 20. Heat from the elongated barrel 20 escapes through the plurality of first and second openings 52, 64. Tightening the sleeve nut 16 has the unexpected result of tensioning the rifling in the inner diameter of the elongated tube and improving shooting accuracy of the firearm barrel with non-metal outer sleeve 1. Tightening the sleeve nut 16 also stretches the elongated tube 20. The first non-metal tube 12 and the second non-metal tube 14 allow the weight of the firearm barrel with non-metal outer sleeve 1 to be reduced while improving shooting accuracy.

Figure 10:
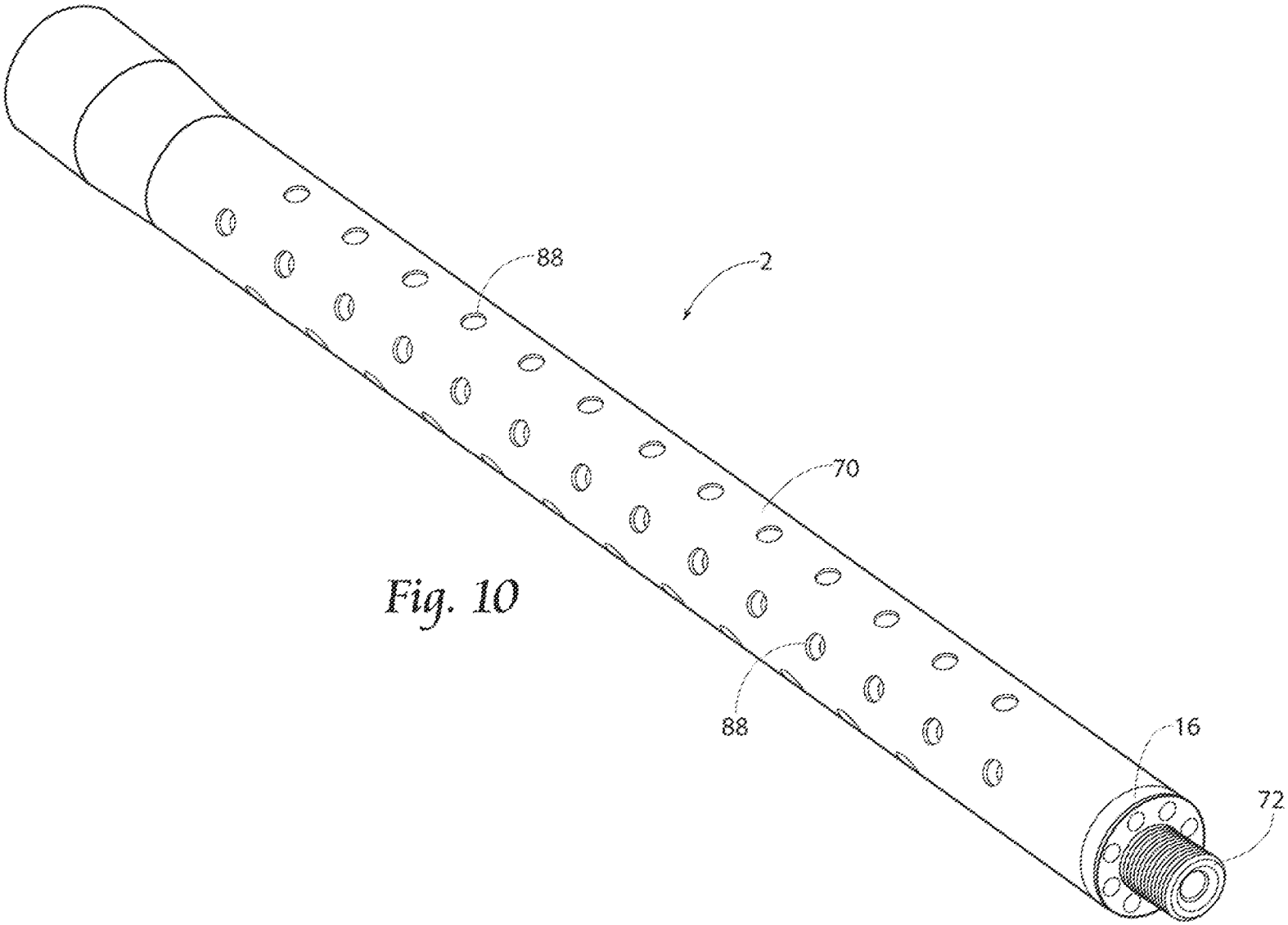
FIG. 10 is a perspective view of a second embodiment of a firearm barrel with non-metal outer sleeve in accordance with the present invention.
Figure 11:
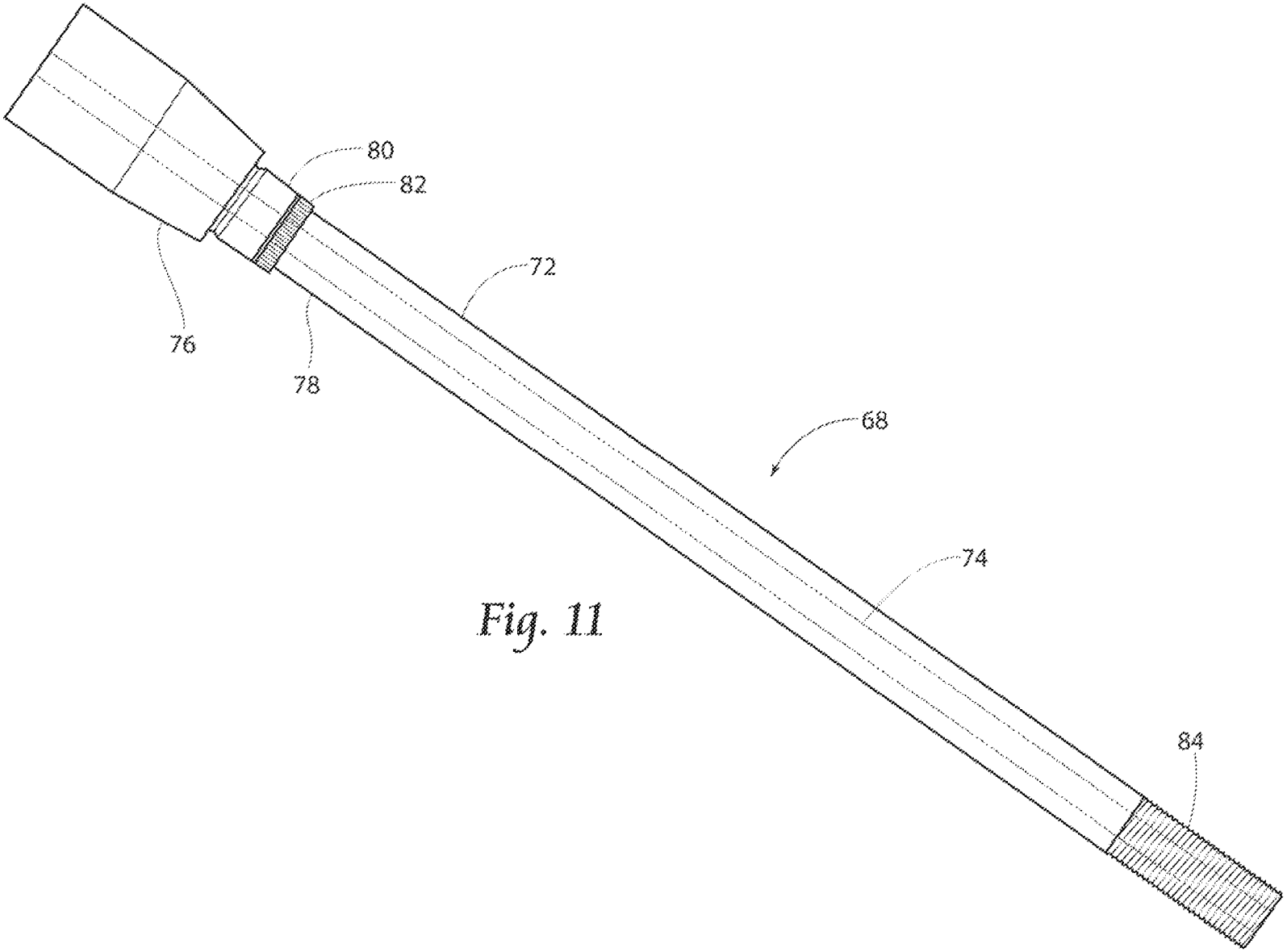
FIG. 11 is a side view of a second elongated tube of a second embodiment of a firearm barrel with non-metal outer sleeve in accordance with the present invention.

With reference to FIGS. 10-11, a second embodiment of a firearm barrel with non-metal outer sleeve 2 preferably includes a second firearm barrel 60, a non-metal tube 70 and the sleeve nut 16. The second firearm barrel 68 includes a second elongated tube 72. A second barrel inner diameter 74 is formed through a length of the second elongated tube 72. Suitable twist rifling is applied to the second barrel inner diameter 74. Material is preferably removed from the second elongated tube 72 to form an end taper 76, a reduced outer diameter 78 and a raised sleeve support section 80. The end taper 76 is formed near an entrance end of the second elongated tube 72. The raised sleeve support section 80 is formed adjacent the end taper 76. The raised sleeve support section 80 preferably includes a straight knurled portion 82 disposed in front of the raised sleeve support section 80. The straight knurled portion 82 will prevent rotation of the non-metal tube 70 relative to the second elongated tube 72 in rare circumstances. A sleeve thread 84 is formed on an exit end of the second elongated tube 72. The firearm barrel is preferably fabricated from any suitable steel, but other materials may also be used. The sleeve nut 16 includes the threaded bore 58, which is sized to threadably receive the sleeve thread 84.

The non-metal tube 70 includes a tube inner diameter and a plurality of openings 88 formed through a wall of the non-metal tube 70. The plurality of openings may 83 have any suitable spacing, size and shape. The tube inner diameter is sized to slidably receive an outer diameter of the raised sleeve support section 80, the straight knurled portion 82 and the tube end 54 of the sleeve nut 16. The non-metal tube 70 is preferably fabricated from carbon fiber, but other non-metal materials could also be used.

The firearm barrel with non-metal outer sleeve 2 is preferably assembled in the following manner. The non-metal tube 70 is slid over the exit end of the second elongated tube 72 on to the raised sleeve support section 80. The sleeve nut 16 is threaded onto the sleeve thread 84 to retain the non-metal tube 70 on the second elongated tube 72. The outer diameter of the tube end 54 is not threadably engaged with the inner diameter of the non-metal tube 70 as shown in FIG. 5. Tightening the sleeve nut 16 has the unexpected result of tensioning the rifling in the inner diameter of the elongated tube 72 and improving shooting accuracy of the firearm barrel with non-metal outer sleeve 2. The non-metal tube 70 allows the weight of the firearm barrel with non-metal outer sleeve 2 to be reduced while improving shooting accuracy. The sleeve nut 16 is threaded on to the sleeve thread 38, tightening of the sleeve nut 16 is not limited by a discontinuation of the sleeve thread 36 on the elongated tube 20 when the rotation flange 56 is in contact with the non-metal tube 70. Additionally, an outer diameter of the tube end 54 is in contact with the inner barrel diameter of the non-metal tube 70, the outer diameter of the tube end 54 is not threadably engaged with the inner diameter of the non-metal tube 70. Shooting accuracy is also improved by having the tube end 54 of the sleeve nut 16 concentric with the threaded bore 56 by no greater than 0.001 inches and the second barrel inner diameter 74 concentric with the second elongated tube 72 by no greater than 0.001 inches. The above concentricity also applies to the firearm barrel with nonmetal outer sleeve 1.

Figure 11A:
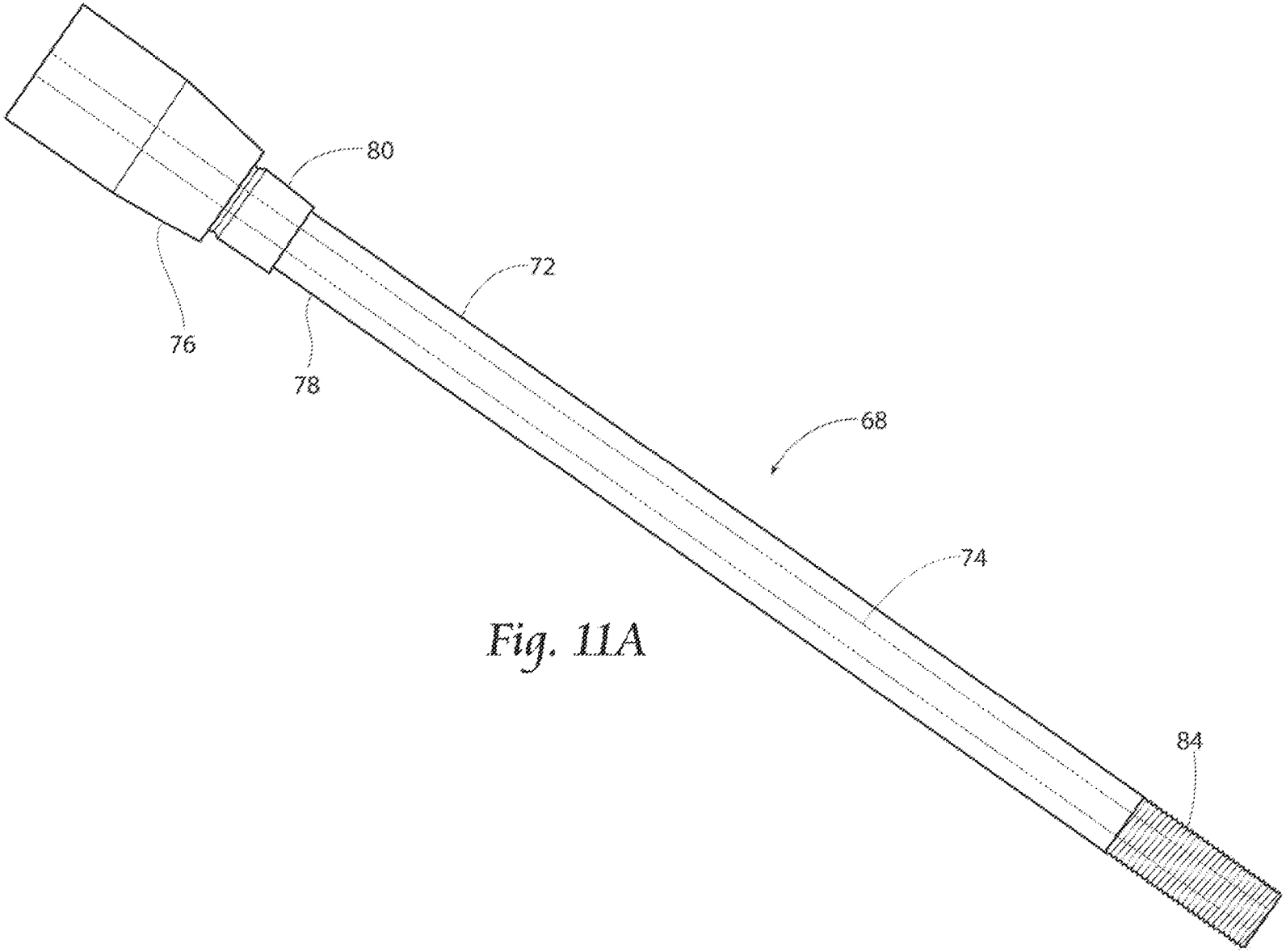
FIG. 11*a* is a side view of a second elongated tube without a straight knurled portion of a second embodiment of a firearm barrel with non-metal outer sleeve in accordance with the present invention.

With reference to FIG. 11A, an alternative design of the raised sleeve support section 60 includes a diameter, which is about 0.004 inches less than an inner diameter of the non-metal tube 70. The lesser diameter of the raised sleeve support section 80 can vary from between 0.002-0.006 inches, but other dimension could also be used instead of about 0.004 inches. A bonding substance is applied to the raised sleeve support section 80. The raised sleeve support section 80 is inserted into non-metal tube 70 and rotated to ensure that any suitable bonding substance is evenly distributed around a gap between the inner diameter of the non-metal tube 70 and the raised sleeve support section 80. The following product is given by way of example and not way of limitation. An example of a suitable bonding substance is J-B Weld®. Further it is also preferable to make the tube end 54 of the sleeve nut 16 about 0.004 inches less than the inner diameter of the non-metal tube 70. The lesser diameter of the tube end 54 can vary from between 0.002-0.006 inches, but other dimension could also be used instead 0.004 inches. The bonding substance is applied to the raised sleeve support section 80. The above bonding also applies to the firearm barrel with non-metal outer sleeve 1.

Figure 12:
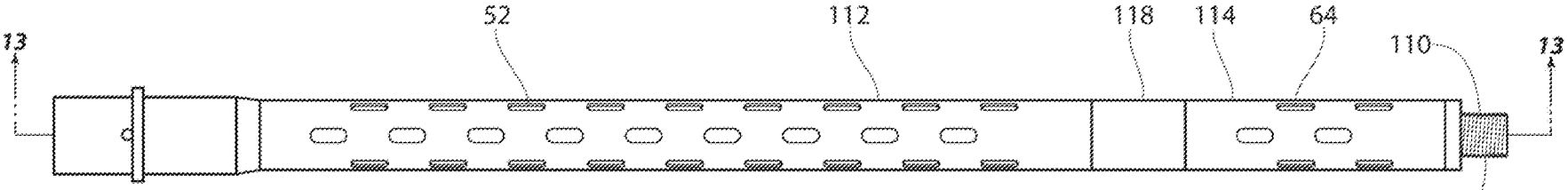
FIG. 12 is a planar view of an alternate embodiment of a firearm barrel with an outer tube according to the present invention.
Figure 13:
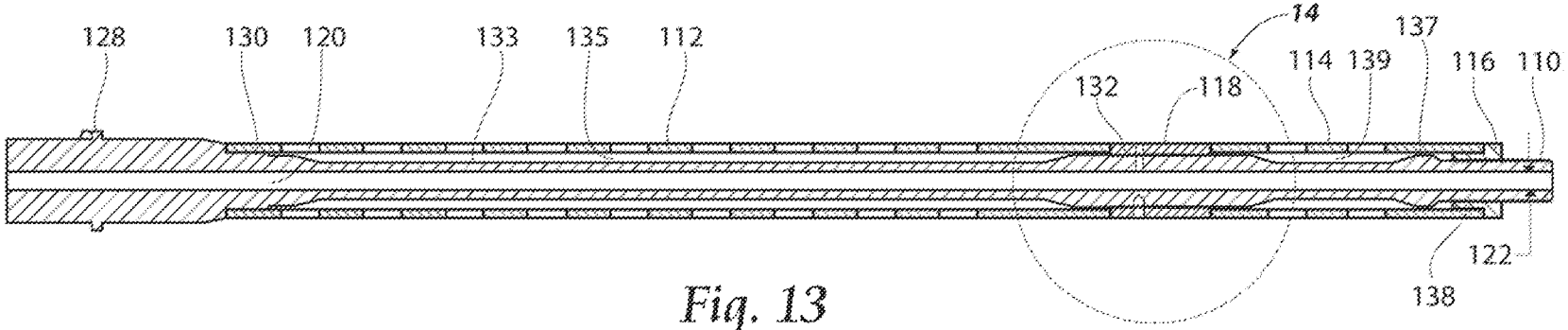
FIG. 13 is a cross-sectional view of the firearm barrel of FIG. 12 taken along the line 13-13 of FIG. 2.

FIGS. 12 and 13 provide an alternative embodiment of the barrel assembly of the present invention. The embodiment is similar to the embodiments, discussed above, but provides for alternate securing means. A barrel 110 is concentrically located within non-metal tubes or sleeves 112 and 114. A sleeve nut 116 secures the sleeves 112 and 114 in place, with coupler bushing 118 located between the non-metal tubes 112 and 114. As shown in the cross-sectional view of FIG. 13, the barrel 110 forms an elongated tube 120 have an inner diameter 122. The barrel 110 is concentrically formed with a lead-in bore 124, which is further formed with a flange 128. The barrel 110 is machined so that a first raised sleeve section 130 is formed so that the sleeve 112 will be positioned on the raised sleeve section 130 when assembled. The barrel 110 also has a raised coupler section 132, preferably having the same diameter as the raised sleeve section. The sleeve section 130 tapers downwardly to a reduced diameter 133 which will then taper upwardly to the raised coupler section 132, thereby forming an air gap 135 between the sleeve 112 and the barrel 110. The raised coupler section 132 further tapers downwardly to the reduced diameter 133 in the area of the barrel 110 aligned with the second sleeve 114. The outer surface of the barrel 110 may have a further tapered section 137 that will abut the sleeve 114 when assembled, thereby forming a second air gap 133. A sleeve thread 138 is formed on an exit end of the elongated tube 120 to allow the sleeve nut 116 to be threaded onto the tube and secure the barrel assembly in place.

Figure 14:
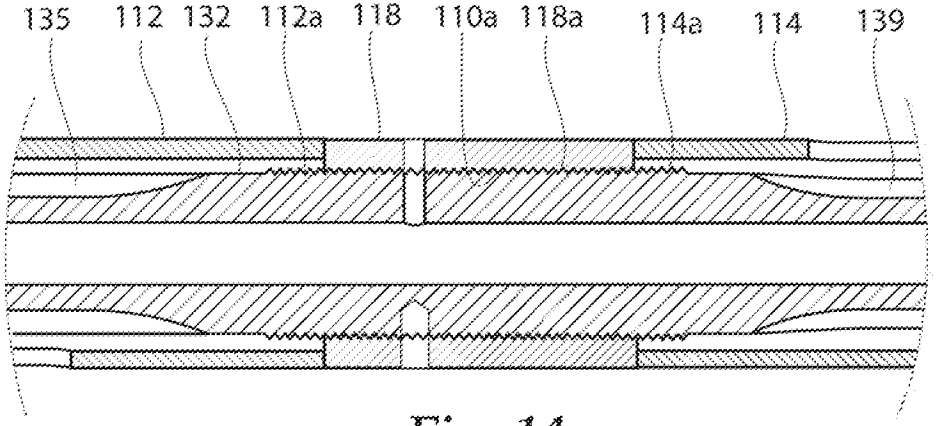
FIG. 14 is an up close view of section XX of FIG. 13.

As previously noted above, the sleeve 112 can be secured to the raised sleeve section 130 by the use of a bonding agent as discussed with respect to FIG. 11A or threaded on as discussed with respect to FIGS. 2-7. However, as demonstrated in FIG. 14, a threaded arrangement is used to secure the coupler bushing 118 in place. The bushing 118 has a threaded surface 111*a* that interacts with a threaded surface 110*a* of the barrel 110. The threaded surface 110*a* extends far enough to engage with threaded surfaces 112*a* and 114*a* of the respective sleeves 112 and 114. As with the previous embodiments, the arrangement provides for a consistent pressure along the barrel 110 when in use. That is, the pressure exerted between the barrel 110 and the sleeve 112 is the same as the pressure exerted between the barrel 110 and the sleeve 114.

Figure 15:
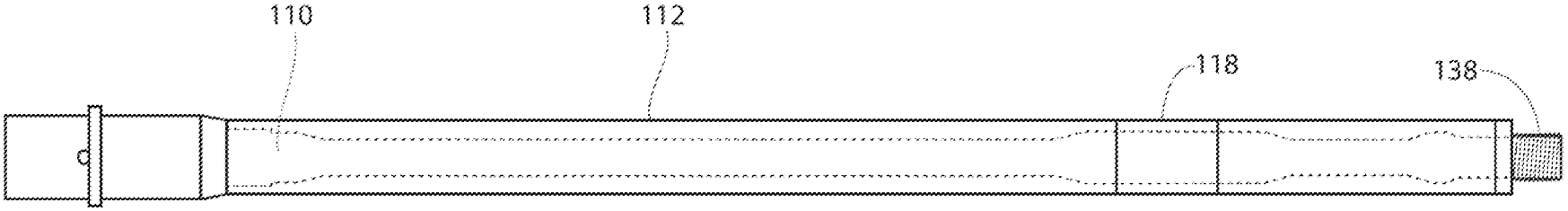
FIG. 15 is a planar view of an alternate arrangement of the embodiment of FIG. 12.
Figure 16:
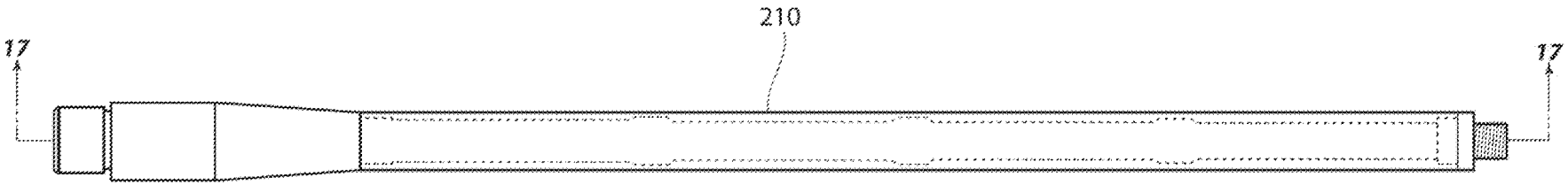
FIG. 16 is a planar view of a further embodiment of the present invention.
Figure 17:
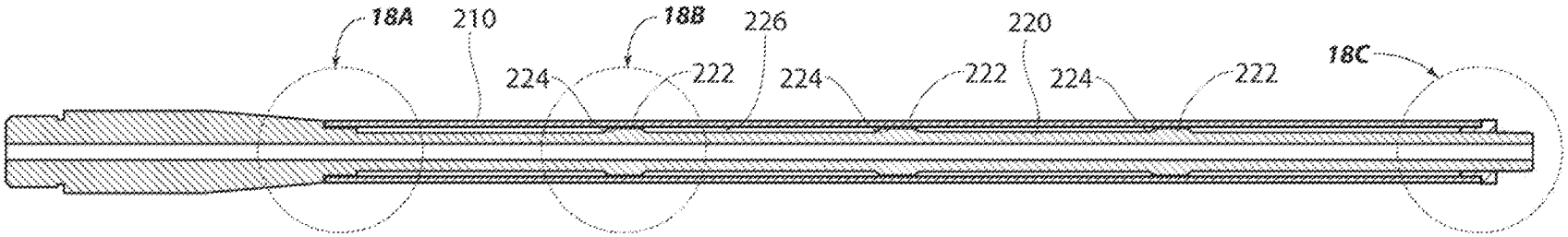
FIG. 17 is a cross-sectional view of the firearm barrel of FIG. 15 taken along the line 17-17 of FIG. 16.

FIG. 13 shows the outer sleeves 112 and 114 having a plurality of openings 52 and 64. However, as shown in FIG. 15, the bushing 118 could be used with sleeves 112 and 114 without any additional openings.

As is appreciated from the various embodiments discussed above, the present invention provides a unique arrangement of a gun barrel and an outer sleeve that provides a unique arrangement that allows the concentricity of the gun barrel and the outer sleeve to remain consistent after firing of the gun. FIGS. 16-18C demonstrate an alternate arrangement that will fall within the scope of the present invention. The arrangement would be preferably be used for a bolt style barrel and sleeve. A barrel 210 is shown concentrically within an outer sleeve 212. A sleeve nut 216 secures the outer sleeve 212 to the barrel 210. The barrel 210 has an outer diameter 220 and a plurality of raised sections 222 that abut the inner surface 224 of the outer sleeve 212. Air gaps 226 are formed between the outer sleeve and the barrel 210.

Figure 18C:
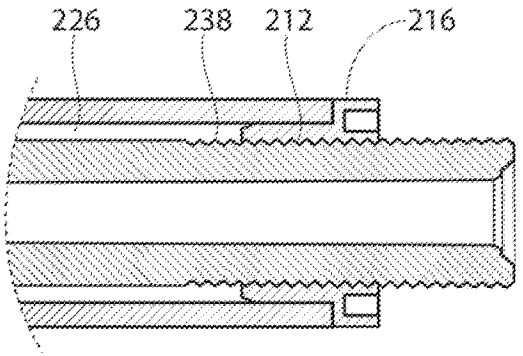
FIG. 18C is a close-up view of section 18C of FIG. 17.
Figure 18B:
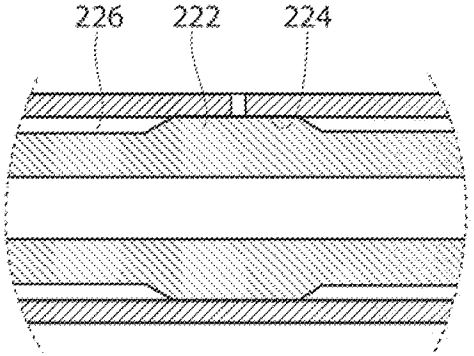
FIG. 18B is a close-up view of section 18B of FIG. 17.
Figure 18A:
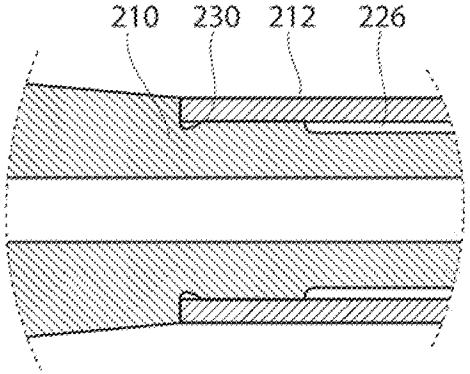
FIG. 18A is a close-up view of section 13A of FIG. 17
Figure 19:
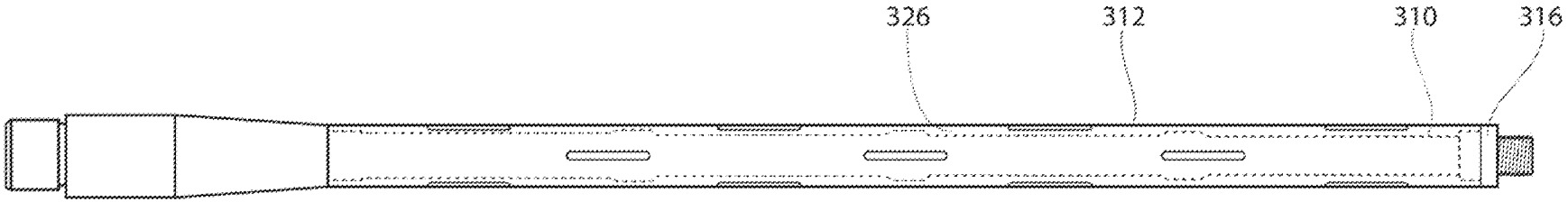
FIG. 19 is planar view of the firearm barrel of FIG. 17.

FIG. 18A provides an enlarged view where the outer sleeve 212 is mated with the barrel 210. As the sleeve 212 is slid onto the barrel 210, it will be positioned on a raised sleeve section 230 when assembled. As previously noted above, the sleeve 212 can be secured to the raised sleeve section 230 by the use of a bonding agent, as discussed with respect to FIG. 11A.

FIG. 18B provides an enlarged view of the raised section 222 engaged with the inner surface 224 of the outer sleeve 212. When the sleeve 212 is slid over the barrel, the abutment of the sleeve 212 and the raised section 222 will assist in maintaining a constant pressure along the barrel, as well as assisting in maintain the concentricity of the barrel 210 and the sleeve when in use.

FIG. 18C shows an enlarged view of a sleeve nut 216 that will be used to secure the sleeve 212 in place on the barrel 210. The sleeve nut 212 will be threaded on a sleeve thread 238 located on the barrel in a fashion as described above with the other various embodiments. The arrangement also assists in maintaining the concentricity and pressure of the barrel 210 and the sleeve 212.

Figure 20:
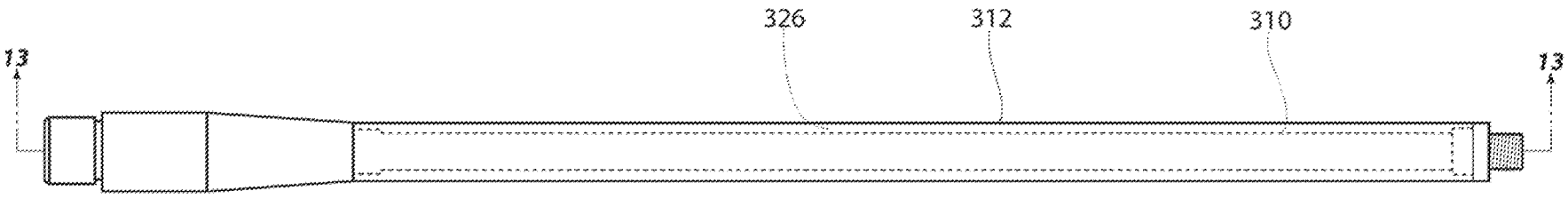
FIG. 20 is a planar view of a further embodiment of the present invention.
Figure 21:
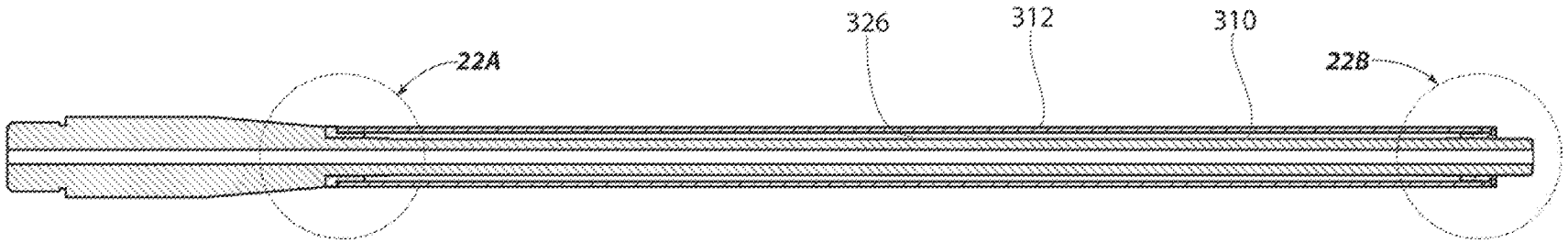
FIG. 21 is a cross-sectional view of FIG. 20.
Figure 22B:
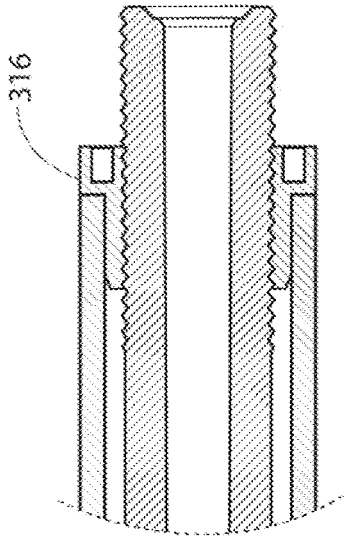
FIG. 22B is a close-up view of FIG. 21 taken along the area of 22B in FIG. 21.
Figure 22A:
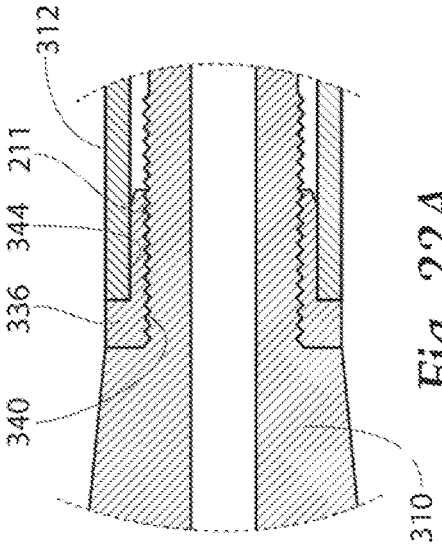
FIG. 22A is a close-up view of FIG. 21 taken along the area of 22A in FIG. 21.

FIGS. 20-22B further demonstrate the adaptability of the present invention to provide a barrel and sleeve arrangement where the concentricity and pressure distribution is maintained during use. FIG. 20 provides a barrel 310 and a sleeve 312, with an air gap 326 formed between them. The arrangement is similar to other arrangements in that a sleeve nut 316 is used to secure the sleeve 312 on the barrel 310, as can be seen in FIG. 22B. Similarly a second sleeve nut 336 is use to position the sleeve 312 on the barrel, as is shown in FIG. 22A. The barrel 312 has a threaded outer portion 338. A threaded inner portion 340 of the sleeve nut 336 will allow for the sleeve nut 336 to be secured to the barrel 210 on a mating threaded portion 211. The outer surface 342 provides a raised sleeve section 344 that allows the sleeve 312 to be properly positioned and retained on the barrel 310 in a concentric fashion.

Figure 23:
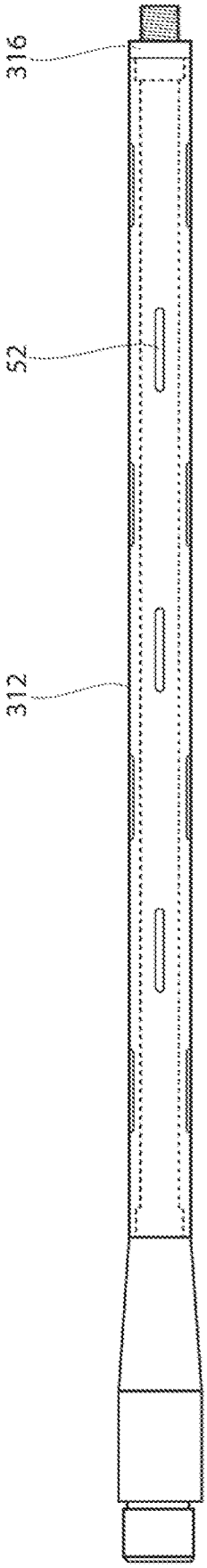
FIG. 23 is a further embodiment of the present invention.

FIG. 23 demonstrates that the barrel 310 and sleeve arrangement 312 may also be used when openings 52 are located in the sleeve 312. It should be understood that any of the various securing means described in the above embodiments could be used with one another and still fall within the scope of the present invention. Provided that a barrel and sleeve arrangement is designed so that the concentricity of the two is maintained throughout use of the barrel, the design would fall within the scope of the present invention.

For example, the firearm barrel assemblies of the present invention generally consists of an internal firearm barrel and an outer sleeve. The inner barrel is formed of a metal material, such as steel, while the outer sleeve is formed of a non-metal material, such as carbon graphite or Kevlar® material. The ability of the barrel and the sleeve retain a concentric relationship after is a key feature of the present invention, which is carried out by the barrel and sleeve having the same coefficient of expansion (COE). As the assembly heats up when fired, the barrel and sleeve will expand in fashion with each respective COE. However, it was discovered with the present invention that by using non-similar materials having the same or substantially the same COE, the concentricity of the assembly will remain constant throughout use. This is also understood in the above firearm assemblies that include a second outer non-metal sleeve. The second outer non-metal sleeve will also have the same COE as the first outer non-metal sleeve and the inner barrel.

It has been discovered that the novel features of the present invention can be incorporated into various barrel assemblies. As appreciated in the various embodiments discussed above, the ability of the present invention to provide the unexpected result of tensioning the rifling of the inner diameter of the elongated tube, i.e. the gun barrel, and improving shooting accuracy of the firearm barrel can be incorporated into assemblies of varying materials. For example, it is appreciated that the fire arm barrel, e.g. the barrel tube, is preferably machined out of a metal material, e.g. steel. However, it should be appreciated that the outer sleeve could also be formed from a metal material. For example, aluminum or titanium or other similar metal materials could form the outer sleeve, in addition to non-metal materials, e.g. carbon fiber and Kevlar®, discussed above. The tensioning arrangement of the sleeve nut as disclosed herein provides an improved barrel assembly, independently of the material that forms the outer sleeve. The improved barrel assembly of the present invention retains the necessary tension of the barrel and concentricity of the barrel and the outer sleeve or sleeves, while still providing a surface that dissipates heat and is capable of being touched after use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A firearm barrel assembly comprising:

an inner firearm barrel made of a first material, said inner firearm barrel having an entrance end and an exit end, said exit end having a sleeve thread;

said inner firearm barrel includes an end flange positioned at said entrance end of said inner firearm barrel, said inner firearm barrel further including a support section proximate to said end flange;

an outer sleeve secured around said inner firearm barrel and supported by said support section, said outer sleeve made of a second material;

an air gap formed between said inner firearm barrel and said outer sleeve, said sleeve thread having a distal end and a proximal end; and a sleeve nut threaded onto said exit end of said inner firearm barrel past said distal end of said sleeve thread and allowing said distal end to extend outwardly past said sleeve nut to secure said outer sleeve in place on said inner firearm barrel, wherein tightening said sleeve nut on said inner firearm barrel fully tensions said inner firearm barrel and compresses said outer sleeve.

2. The firearm barrel assembly of claim 1, wherein said first material comprises a metal.

3. The firearm assembly of claim 2, wherein said first material is steel.

4. The firearm barrel assembly of claim 1, wherein said second material comprises a carbon fiber material.

5. The firearm assembly of claim 1, wherein said second material comprises aluminum or titanium.

6. The firearm assembly of claim 1, wherein openings are located in said outer sleeve.

7. A firearm barrel assembly comprising:

an inner firearm barrel made of a first material, said inner firearm barrel having an entrance end and an exit end and a sleeve thread located at said exit end, said sleeve thread having a proximal end and a distal end;

a first outer sleeve secured around said inner firearm barrel, said first outer sleeve made of a second material;

a second outer sleeve axially aligned with said first outer sleeve and secured around said inner firearm barrel, said second outer sleeve made of said second material;

a gas bushing positioned around said inner firearm barrel and between said first and said second outer sleeves;

an air gap formed between said inner firearm barrel and said outer sleeves; and a sleeve nut threaded onto said exit end past said distal end of said sleeve thread of said inner firearm barrel and allowing said distal end to extend outwardly past said sleeve nut to secure said first and said second outer sleeves in place on said inner firearm barrel, wherein tightening said sleeve nut on said inner firearm barrel fully tensions said inner firearm barrel and compresses said first and said second outer sleeves.

8. The firearm barrel assembly of claim 7, wherein said first material comprises a metal.

9. The firearm assembly of claim 8, wherein said second material is selected from the group consisting of: titanium, and aluminum.

10. The firearm barrel assembly of claim 7, wherein said second material comprises a carbon fiber material.

11. The firearm assembly of claim 7, wherein said second material comprises aluminum.

12. The firearm assembly of claim 7, wherein openings are located in said first and said second outer sleeves.

13. A method of forming a barrel assembly comprising the steps of:

providing a firearm barrel having an entrance end and an exit end and a sleeve thread having a proximal end and a distal end located on said exit end;

providing an outer sleeve;

providing a sleeve nut;

securing said outer sleeve over said firearm barrel;

forming an air gap between said outer sleeve and said firearm barrel; and threading said sleeve nut onto said firearm barrel past said distal end of said sleeve thread and allowing said distal end to extend outwardly past said sleeve nut to secure said outer sleeve in place, wherein said threading of said sleeve nut fully tensions said firearm barrel and compresses said outer sleeve.

14. The method of claim 13, wherein said step of threading said sleeve nut maintains a concentric arrangement between said outer sleeve and said firearm barrel when said barrel assembly is in use.

15. The method of claim 13 wherein said step of securing said outer sleeve further comprises applying an adhesive to said outer sleeve or said firearm barrel.

16. The method of claim 13 further comprising the steps of:

providing a gas bushing and a second outer sleeve;

aligning said gas bushing between said outer sleeve and said second outer sleeve, wherein said step of threading said sleeve nut onto said firearm barrel further secures said gas bushing and said second outer sleeve in axial alignment with said outer sleeve.

17. The method of claim 16, wherein said step of threading said sleeve nut maintains a concentric arrangement between said outer sleeve and said firearm barrel when said barrel assembly is in use.

18. The method of claim 13, wherein said outer sleeve comprises a non-metal material.

19. The method of claim 13, wherein outer sleeve comprises a metal material.

20. The method of claim 19, wherein said firearm barrel comprises steel.

* * * * *